US009670605B2

(12) United States Patent
Tone et al.

(10) Patent No.: US 9,670,605 B2
(45) Date of Patent: Jun. 6, 2017

(54) HIGH-DENSITY FABRIC

(75) Inventors: Hajime Tone, Osaka (JP); Hideki Kawabata, Osaka (JP)

(73) Assignee: TOYOBO SPECIALTIES TRADING CO., LTD., Osaka (JP)

( * ) Notice: Subject to any disclaimer, the term of this patent is extended or adjusted under 35 U.S.C. 154(b) by 135 days.

(21) Appl. No.: 13/641,001

(22) PCT Filed: Aug. 29, 2011

(86) PCT No.: PCT/JP2011/069459
§ 371 (c)(1),
(2), (4) Date: Oct. 12, 2012

(87) PCT Pub. No.: WO2012/032957
PCT Pub. Date: Mar. 15, 2012

(65) Prior Publication Data

US 2013/0035014 A1 Feb. 7, 2013

(30) Foreign Application Priority Data

Sep. 7, 2010 (JP) ..... 2010-200221

(51) Int. Cl.
*D03D 15/00* (2006.01)
*D03D 13/00* (2006.01)

(52) U.S. Cl.
CPC ..... *D03D 13/008* (2013.01); *D03D 15/00* (2013.01); *D10B 2501/06* (2013.01); *D10B 2503/062* (2013.01); *Y10T 442/3065* (2015.04)

(58) Field of Classification Search
CPC ..... D03D 13/008; D03D 15/0088
(Continued)

(56) References Cited

U.S. PATENT DOCUMENTS 4,916,000 A * 4/1990 Li et al. ..... 428/105
5,102,735 A * 4/1992 Shiojima et al. ..... 428/370
(Continued)

FOREIGN PATENT DOCUMENTS

JP 56-005687 A 1/1981
JP 04-504740 A 8/1992
(Continued)

OTHER PUBLICATIONS

Japanese Patent Office, International Search Report in International Patent Application No. PCT/JP2011/069459 (Nov. 29, 2011).
(Continued)

*Primary Examiner* — Andrew Piziali
(74) *Attorney, Agent, or Firm* — Wenderoth, Lind & Ponack, L.L.P.

(57) ABSTRACT

Provided is a fabric that is favorably used for a side cloth of a down wear, a down jacket, a futon, a sleeping bag or some other, and that is light, thin and high in tear strength and can further keep a low air permeability after washed. The high-density fabric of the present invention that can attain the purpose is a fabric including a synthetic fiber that has a fineness of 28 dtex or less, and having a total cover factor ranging from 1700 to 2200. In this fabric, multifilaments are present in each of which monofilaments are arranged in the form of two layers in at least one direction of warp and weft directions. Furthermore, the fabric has a cover factor ranging from 700 to 900 in at least one direction of the warp and weft directions which has the multifilaments present.

20 Claims, 3 Drawing Sheets

(58) Field of Classification Search
USPC ..... 442/189, 192
See application file for complete search history.

(56) References Cited

U.S. PATENT DOCUMENTS

| | | | | |
|---|---|---|---|---|
| 5,466,514 | A * | 11/1995 | Kataoka et al. | 442/81 |
| 6,883,556 | B2 | 4/2005 | Fahrer et al. | |
| 8,220,499 | B2 | 7/2012 | Fukunishi et al. | |
| 2004/0173273 | A1 | 9/2004 | Fahrer et al. | |
| 2006/0183390 | A1 | 8/2006 | Fukunishi et al. | |
| 2007/0202763 | A1 | 8/2007 | Shibaoka et al. | |

FOREIGN PATENT DOCUMENTS

| | | | |
|---|---|---|---|
| JP | H10-110376 | A | 4/1998 |
| JP | 10-245741 | A | 9/1998 |
| JP | 2001-270406 | A | 10/2001 |
| JP | 2002-275729 | A | 9/2002 |
| JP | 2004-084091 | A | 3/2004 |
| JP | 2004-183193 | A | 7/2004 |
| JP | 2004-339640 | A | 12/2004 |
| JP | 2005-048298 | A | 2/2005 |
| JP | 2006-052505 | A | 2/2006 |
| JP | 2006-057219 | A | 3/2006 |
| JP | 2006-512513 | A | 4/2006 |
| JP | 2006-348411 | A | 12/2006 |
| JP | 2009-013511 | A | 1/2009 |
| WO | WO 2005/095690 | A1 | 10/2005 |

OTHER PUBLICATIONS

Japanese Patent Office, Notice of Submission of Information by Third Parties in Japanese Patent Application No. 2010-200221 (Nov. 1, 2012).

Chinese Patent Office, Office Action in Chinese Patent Application No. 201180020681.2 (Dec. 24, 2013).

Japanese Patent Office, Notice of Reasons for Rejection in Japanese Patent Application No. 2010-200221 (Nov. 12, 2013).

Chinese Patent Office, The Second Office Action in Chinese Patent Application No. 201180020681.2 (Aug. 26, 2014).

Japanese Patent Office, Notice of Submission of Information by Third Parties in Japanese Patent Application No. 2010-200221 (Jun. 24, 2014).

Japanese Patent Office, Notice of Reasons for Rejection in Japanese Patent Application No. 2010-200221 (Jul. 1, 2014).

Chinese Patent Office, First Office Action in Chinese Patent Application No. 201180020681.2 (Apr. 1, 2014).

Japanese Patent Office, Notice to Applicant regarding Submission of Information by Third Party in Japanese Patent Application No. 2010-200221 (Apr. 22, 2014).

* cited by examiner

HIGH-DENSITY FABRIC

CROSS-REFERENCE TO RELATED APPLICATIONS

This patent application is the U.S. national phase of International Patent Application No. PCT/JP2011/069459, filed Aug. 29, 2011, which claims the benefit of Japanese Patent Application No. 2010-200221, filed Sep. 7, 2010, which are incorporated by reference in their entireties herein.

TECHNICAL FIELD

The present invention relates to a high-density fabric which is light, thin, and large in tear strength, and can further keep a low air permeability after the fabric is washed, and more specifically to a high-density fabric from which cotton or down is restrained from spouting out and is favorably used, in particular, for a side cloth of a down wear, a down jacket, a futon (i.e., Japanese bedding), a sleeping bag or some other.

BACKGROUND ART

A cloth used in side cloths of down wears or futons is required to have a low air permeability in order to restrain cotton or down from spouting out. The cloth is also required to be light and thin.

In the past, for the cloth, a natural fiber, such as silk or cotton, which is excellent in feeling or comfortableness, has been used. However, the cloth made of natural fibers are small in tear strength and poor in durability; thus, when the cloth is used, in particular, for a down wear, there is caused a problem that cotton or down spouts from an elbow or a sleeve portion thereof.

In contrast, the fabrics made of a polyester multifilament, a nylon multifilament or a composite synthetic fiber of these filaments have also been frequently used for the above-mentioned cloth since mechanical properties thereof are excellent. These fabrics are frequently used for coats, blousons, golf wears, outdoor wears for sports, and other wears since these fabrics are soft, light, and excellent in windproofness, water repellency, strength and others. However, the fabrics are required to have a dense structure in order to keep down proof for restraining down from spouting out from the fabrics. Thus, there arises a problem that the fabrics become hard. In order to solve this problem, for example, various fabrics are suggested to make improvements, as disclosed in Patent Documents 1 to 3.

<High-Density Fabric Using Microfiber>

Patent Document 1 discloses a side cloth for a futon wherein use is made of a spun yarn or long fiber yarn comprising monofilaments having an average fineness of 0.5 denier or less. This side cloth is a high-quality side cloth for a futon, which causes no cotton to spout from the cloth and has a soft feeling, a rich drapability, and a good gloss. Although the feeling of the side cloth is soft since the fineness of the monofilaments thereof is small, the number of the filaments that constitutes the yarn is large so that the yarn becomes thick. As a result, the cloth becomes thick. Thus, the side cloth is not a cloth having lightness, thinness, and down proof.

<Thin High-Density Fabric Using Multifilaments Having Small Total Fineness>

Patent Document 2 suggests a polyester fabric which has a total cover factor of 1500 or more and a weight per unit area of 45 g/m$^2$ or less, which comprises a polyester multifilament A yarn ha ring a total fineness of 25 dtex or less and a monofilament fineness of 2.0 dtex or less, and a multifilament B yarn having a total fineness of 35 dtex or more, in which in a yarn-arrangement in each of warp and weft directions the constituent-filament-ratio (ratio by filament number) of the B yarn to the A yarn is from ¼ to 1/20, and the pitch between the A yarn and the B yarn is 7 mm or less. Polyester multifilaments far finer than conventional multifilaments is used for this polyester fabric, and the fabric is lighter, higher in density; and softer, while a sufficient tear strength is exhibited. Although the fabric is soft since the far finer polyester multifilaments are used therein, it is necessary for heightening the strength of the fabric to use the B yarn, which has a large fineness of 35 dtex or more. Further, the fabric has a problem that the constituent-filament-ratio of the A yarn to the B yarn is restricted.

<High-Density Fabric Using Microfiber & Textured Yarn>

Patent Document 3 discloses a high-density fabric wherein use is made of a polyester long fiber yarn having a monofilament fineness of 0.6 denier or less and a total fineness of 60 to 120 deniers, wherein warps are made of crimped yarn, and the total fineness (WD) of the warps, the total fineness (FD) of wefts, and the cover factor (WCF) of the warp are each regulated into a specified range. This high-density fabric is a fabric that has a high waterproofing property, is well-tailored after the fabric is sewed up, further has a tear strength the level of which does not cause any practical problem, and is soft. However in order to prevent the fabric from slant upward even when the yarn constituting the fabric is curved with a sewing needle at the time of sewing this fabric, a false twist textured yarn having a large fineness of 60 deniers or more is used. For this reason, the high-density fabric with lightness and thinness, softness and further having an excellent down proof cannot be obtained.

PRIOR ART DOCUMENTS

Patent Documents

Patent Document 1: JP 56-5687 A
Patent Document 2: JP 2005-095690 A1
Patent Document 3: JP 10-245741 A

SUMMARY OF THE INVENTION

Problems to be Solved by the Invention

The present invention has been made in light of the problems in the prior art. More specifically; an object of the present invention is to provide a fabric which is favorably used for a side cloth of a down wear, a down jacket, a futon, a sleeping bad, or some other, and which, is light, thin, and large in tear strength and can further keep a loser air permeability after the fabric is washed.

Solutions to the Problems

The inventors have made eager investigations to solve the above-mentioned problem- and made the present invention.

Accordingly, the high-density fabric of the present invention is characterized in being made of a synthetic fiber that has a fineness of 28 dtex or less; having a total cover factor ranging from 1700 to 2200; multifilaments being present in each of which mono-filaments are arranged in the form of two layers in at least one direction of warp and weft directions; and having a cover factor ranging from 700 to 900 in at least one direction of the warp and weft directions which has the multifilaments present.

As described above; the fineness of the synthetic fiber, and the cover factor and the total cover factor in the warp direction or the weft direction are each specified, and further the multifilaments having a yarn cross-sectional form and arranged in the form of two layers in at least one direction of the warp and weft directions are present in the fabric, thereby making it possible to restrain a deterioration in the air permeability caused by washing or some other by decreasing the air permeability of the fabric, and to make the fabric thin and soft.

The multifilaments preferably have a total fineness of 11 to 28 dtex, and the number of the monofilaments in each of the multifilaments is preferably from 12 to 22. The multifilaments are preferably false twist textured yarn. Further, the multifilaments preferably have a breaking strength of 4.5 cN/dtex or more. In addition, a proportion of the multifilaments is preferably 50% or more.

The high-density fabric subjected to calendaring at least one surface of the fabric is preferably used in the present invention.

Further, an air permeability of the high-density fabric, which is measured with reference to the air permeability A method prescribed in JIS L 1096 8. 27. 1 after the fabric is washed 3 times, is preferably 2 $cc/cm^2/s$ or less. The air permeability of the high-density fabric is kept 2 $cc/cm^2$ is or less so that the high-density fabric of the invention can keep a low air permeability after washed.

Effects of the Invention

The high-density fabric of the present invention is light and thin, and has a very soft feeling. Further, the fabric has a high tear strength and can further keep a low air permeability also after washed. Thus, the fabric is favorably used for a side cloth of a down wear, a down jacket, a futon, a sleeping bag or some other.

MODE FOR CARRYING OUT THE INVENTION

Figure 1:
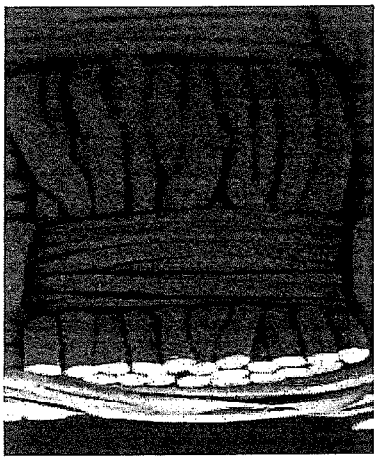
FIG. 1 shows an SEM photograph of a cross section of a fabric (false twist textured yarn fabric) illustrating a two-layer arrangement.

Hereinafter, embodiments of the present invention will be described in detail.

The high-density fabric of the present invention is a fabric comprising a synthetic fiber that has a fineness of 28 dtex or less, and having a total cover factor ranging from 1700 to 2200. Further, multifilaments are present in each of which monofilaments are arranged in the form of two layers in at least one direction of warp and weft directions. In addition, the fabric of the present invention has a cover factor ranging from 700 to 900 in at least one direction of the warp and weft directions which has the multifilaments present.

Firstly, the synthetic fiber used in the high-density fabric of the present invention is described.

<Material of Synthetic Fiber>

The material of the synthetic fiber is not particularly limited, and examples thereof include polyesters such as polyethylene terephthalate, polypropylene terephthalate, and polybutylene terephthalate; polyamides such as nylon 6, nylon 66, nylon 46, nylon 12, nylon 610 and nylon 612, and copolymers of them, and synthetic polymers such as polyacrylonitrile, polyvinyl chloride, and polyvinyl alcohol. Of these examples, preferred are polyesters and polyamides. Particularly preferred are nylon 6, and nylon 66, since they can make the feeling of the fabric soft.

For example, in the case of using polyesters, the intrinsic viscosity of the material is preferably 0.58 dl/g or more, more preferably 0.60 dl/g or more, and is preferably 1.00 dl/g or less, more preferably 0.90 dl/g or less. The intrinsic viscosity of the material is set into the above range, so that a fiber having an appropriate breaking strength is obtained and the cost can be suppressed. If the intrinsic viscosity of the material is 0.60 dl/g or more, the yarn can gain an appropriate strength even when the yarn is thin. On the other hand, if the intrinsic viscosity of the material is less than 0.58 dl/g, it is feared that there are caused problems that an obtained product is low in tear strength and breaking strength, since the fiber is insufficient in breaking strength. Additionally, it is feared to be deteriorated in working operability and yield a product poor in durability since the fiber is insufficient in breaking elongation. If the viscosity is more than 1.00 dl/g, costs increase very much so that the resultant fabric is lacking in practicability.

For example, in the case of using nylon, the relative viscosity of the material is preferably 2.5 or more, more preferably 3.0 or more. When the relative viscosity of the material is 2.5 or more, the resultant fiber has an appropriate breaking strength. When the relative viscosity of the material is 3.0 or more, the yarn can gain an appropriate strength even when the yarn is thin. On the other hand, if the relative viscosity is less than 2.5, there are easily caused problems that an obtained product is low in tear strength and breaking strength since the fiber is insufficient in breaking strength. Additionally, there are easily caused to be deteriorated in working operability and yield a product poor in durability, since the fiber is insufficient in breaking elongation.

The following components may be optionally added alone or in combination to the material: a hygroscopic substance, an antioxidant, a delustering agent, an ultraviolet absorbent, an antibacterial agent, and others.

<Fineness of Synthetic Fiber>

The fineness of the synthetic fiber is preferably 28 dtex or less, more preferably 22 dtex or less, even more preferably 17 dtex or less. The fineness is preferably 6 dtex or more, more preferably 8 dtex or more, even more preferably 11 dtex or more. The fineness of the synthetic fiber is set into the above range, so that a fabric, which is thin and compact while the fabric has appropriate tear strength, is yielded. On the other hand, if the fineness is more than 28 dtex, the fabric becomes a thick cloth while the fabric has a large tear strength. Thus, the fabric with thinness and softness cannot be obtained. If the fineness is less than 6 dtex, the resultant fabric is small in tear strength although the fabric can be thin and compact. Thus, the fabric may be unsuitable for clothing.

The synthetic fiber may be a short fiber or a long fiber (multifilaments). The multifilaments are preferably used since the filaments easily give a light, thinner and softer fabric.

When the synthetic fiber is made into multifilaments, it is conceivable that the state of the multifilaments are put together in the monofilaments is classified into the following several arrangements.

<Two-Layer Arrangement>

Figure 2:
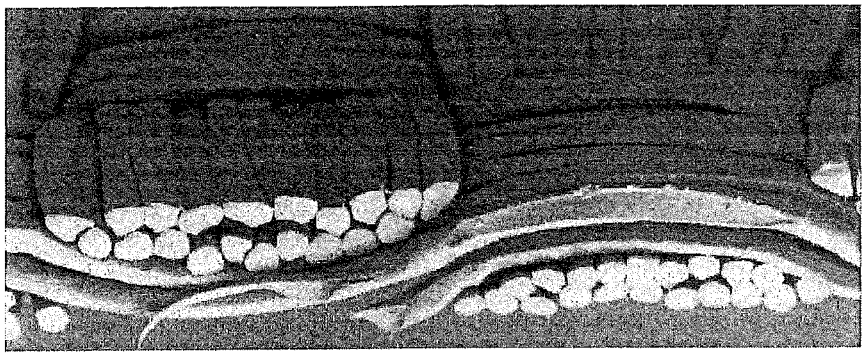
FIG. 2 shows an SEM photograph of a cross section of a fabric (false twist textured yarn fabric) illustrating a two-layer arrangement.
Figure 3:
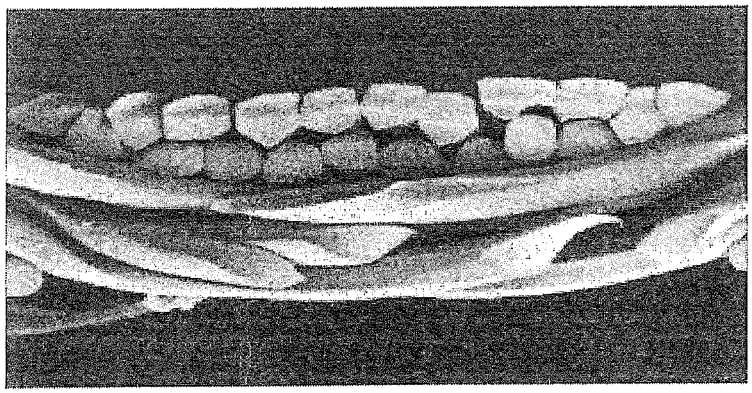
FIG. 3 shows an SEM photograph of a cross section of a fabric (false twist textured yarn fabric) illustrating a two-layer arrangement.
Figure 4:
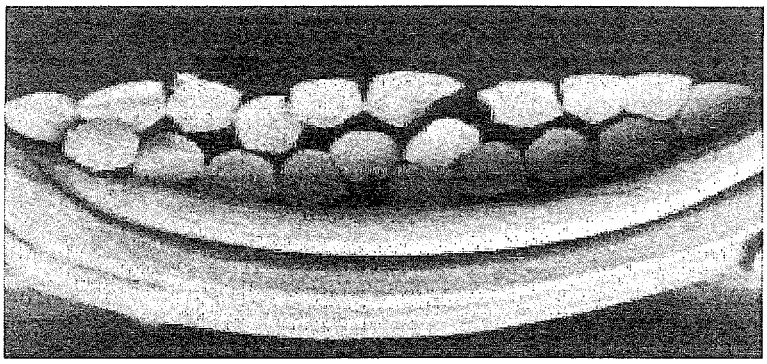
FIG. 4 shows an SEM photograph of a cross section of a fabric (false twist textured yarn fabric) illustrating a two-layer arrangement.

In the present invention, the wording "two-layer arrangement" denotes a state of the following two layers stacked on each other. A first layer is formed by plural monofilaments to be continuous with each other on a line in a cross section of any one of the multifilaments constituting warps and/or wefts of the fabric. A second layer are formed by monofilaments, the number of which is equal to that of those in the first layer, on the first layer (in the thickness direction) to be continuous with each other on a line. In the present invention, a case where the number of monofilaments constituting a single layer and third or more layers is five or less, for example, the following cases are also each regarded to be included in the two-layer arrangement: a case illustrated in FIG. 1, wherein the number of monofilaments which constitute a single layer and a third layer is four (single layer: two monofilaments at the left end, and one monofilament at the right end; third layer: one monofilament at the center); a case illustrated in FIG. 2, wherein the number of monofilaments which constitute a single layer is three (multifilaments at each of the left side and the right side: two monofilaments at the left end, and one monofilament at the right end); a case illustrated in FIG. 3, wherein the number of monofilaments which constitute a single layer is four (two monofilaments at each of the left end and the right end); and a case illustrated in FIG. 4, wherein the number of monofilaments which constitute a single layer and a third layer is three (single layer: two monofilaments, i.e., one monofilament at each of both ends; and third layer: one monofilament at the center).

<One-Layer Arrangement>

Figure 5:
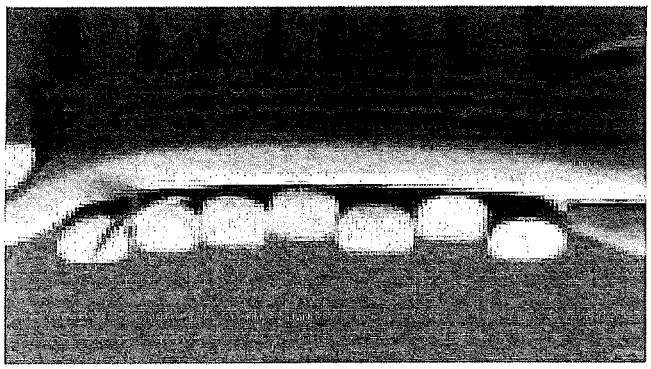
FIG. 5 shows an SEM photograph of a cross section of a fabric (raw yarn fabric) illustrating a one-layer arrangement.
Figure 6:
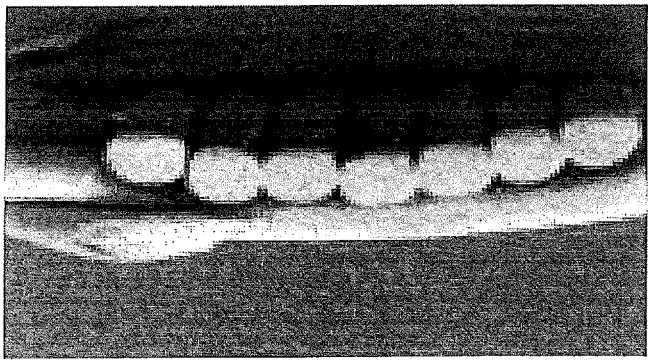
FIG. 6 shows an SEM photograph of a cross section of a fabric (raw yarn fabric) illustrating a one arrangement.

In the present invention, the wording "one-layer arrangement" denotes a state that all monofilaments constituting the multifilament are put together (into a single layer) to be continuous with each other on a line, in a cross section of any one of multifilaments constituting warps and/or wefts of the fabric (FIGS. 5 and 6).

<Three-Layer Arrangement>

Figure 7:
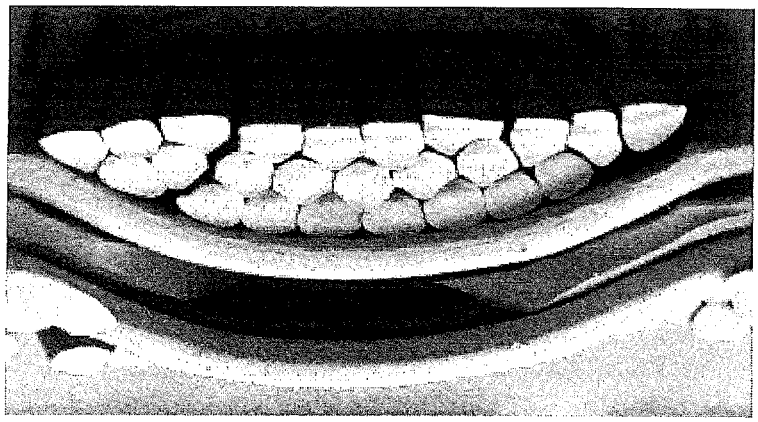
FIG. 7 shows an SEM photograph of a cross section of a fabric (raw yarn fabric) illustrating a three-layer arrangement.
Figure 8:
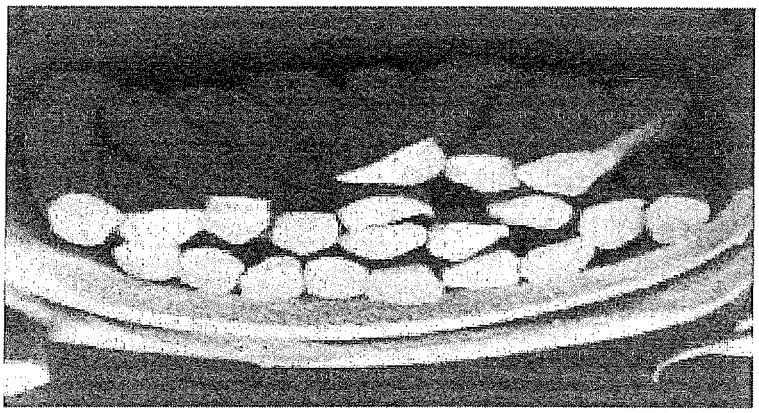
FIG. 8 shows an SEM photograph of a cross section of a fabric (false twist textured yarn fabric) illustrating a three-layer arrangement.

In the present invention, the wording "three-layer arrangement" denotes a state that the following three layers are stacked on each other: a first layer in which plural monofilaments are formed to be continuous with each other on a line; a second layer in which plural monofilaments are formed on the first layer (in the thickness direction) to be continuous with each other on a line; and a third layer which is another layer formed on the second layer (FIGS. 7 and 8).

The wordings "four-layer arrangement" "fifth-layer arrangement", . . . "n-layer arrangement" are each defined in the same manner as described above except that the number of layers stacked on each other is different.

Secondly the multifilaments for the present invention, in each of which the monofilaments arranged into two layers, is described in detail.

The present inventors have found out that it is very important that the multifilaments (the multifilaments may be referred to as the two-layer arrangement multifilaments in the present invention) in each of which monofilaments are arranged in the form of two layers in at least one direction of warp and weft directions of the fabric are present, for yielding a fabric having a low air permeability thinness and softness. Reasons therefor would be as follows.

The thickness of the fabric can be made small by stacking monofilaments therein onto each other into a two-layer arrangement fit addition, the fabric can keep a low air permeability since the monofilaments are stacked on each other vertically into the form of two layers in the state that few voids are present therebetween.

However, when monofilaments are put together into a one-layer arrangement, the fabric can be made thin; however, when the fabric is washed, tissues of the fabric are easily moved since the tissues are made of only the single layer. In other words, in the two-layer arrangement, the upper layer presses on the lower layer, so that the motion (undesired shifty of the multifilaments is restrained when the fabric is washed. On the other hand, in the one-layer arrangement, such a motion-restraining effect is not produced. Thus, it appears that stress generated at the time of the washing causes yarn-slip or shift so that the tissues collapse. As a result, the fabric cannot easily keep a low air permeability after washed. When monofilaments are stacked to each other to be made into an arrangement of three or more layers, a fabric low in air permeability can be obtained. However, the quantity of the stacked layers is large so that the fabric itself turns thick. Thus, a target fabric, which is light, thin and soft, cannot be obtained. When the fabric is used for a down wear or a windbreaker, the compactness of the fabric is inhibited.

<Proportion of Two-Layer Arrangement Multifilaments>

In the present invention, the proportion of the two-layer arrangement multifilaments is preferably 50% or more, more preferably 60% or more, even more preferably 70% or more in order that a fabric satisfying a desired performance can be supplied. When the proportion of the two-layer arrangement multifilaments is 50% or more, a fabric can be yielded which has a low air permeability, thinness and softness. On the other hand, if the proportion is less than 50%, it is feared that the resultant fabric cannot satisfy either one of a low air permeability, and thinness.

The proportion is defined as follows: the number of two-layer arrangement multifilaments, which are each judged to have a two-layer arrangement in accordance with the above-mentioned criterion the number of monofilaments other than any monofilament in a two-layer arrangement form is 5 or less), is divided by the total number of multifilaments present in a (warp or weft) direction in which the two-layer arrangement multifilaments are present.

<Total Fineness of Two-Layer Arrangement Multifilaments>

The total fineness of the two-layer arrangement multifilaments is preferably 28 dtex or less, more preferably 22 dtex or less, and is preferably 11 dtex or more, more preferably 17 dtex or more. When the total fineness of the two-layer arrangement multifilaments is set into the range, a fabric can be yielded to be thin and soft while the fabric has appropriate tear strength. On the other hand, if the total fineness is more than 28 dtex, the resultant fabric has high tear strength, however, the fabric becomes thick, and the fabric is not light, thin and soft. If the total fineness is less than 11 dtex, the resultant fabric is lacking in tear strength although the fabric is light, thin and soft.

<Breaking Strength of Two-Layer Arrangement Multifilaments>

The breaking strength of the two-layer arrangement multifilaments is not particularly limited, and is preferably 4.0 cN/dtex or more, more preferably 4.5 cN/dtex or more, even more preferably 5.0 cN/dtex or more. When the breaking strength of the two layer arrangement multifilaments is 4.0 cN/dtex or more, the high-density fabric of the present invention, wherein a fine yarn is used, can be allowed to have a practical strength. On the other hand, if the breaking strength is less than 4.0 cN/dtex, a fabric having a sufficient tear strength for clothing may not be yielded.

<Breaking Elongation of Two-Layer Arrangement Multifilaments>

The breaking elongation of the two-layer arrangement multifilaments is not particularly limited, either, and is preferably 25% or more, more preferably 28% or more, and is preferably 50% or less, more preferably 48% or less. When the breaking elongation of the two-layer arrangement multifilaments is set into the range, the yarn is elongated to an appropriate extent when the fabric is torn. Thus, stress is applied not only to ones to be torn out of all the yarns but also to ones adjacent thereto. Furthermore, stress is applied to ones adjacent thereto. In such a way, the stress generated when the fabric is torn is dispersed into many ones out of all the yarns. As a result, stress applied to each yarn is decreased so that the tear strength of the fabric appears to be improved. On the other hand, if the breaking elongation is less than 25%, stress generated when the produced fabric is torn is easily concentrated into a single yarn that is being torn, so that the tear strength of the fabric turns small. If the breaking elongation is more than 50%, the original yarns cannot follow a change in tensile force that is associated with a raise in fabric-producing speed, a raise in fabric density and a decrease in fabric abrasion, or friction resistance between the yarns and various thread-touching members, so that the outbreak frequency of yarn breakage may increase. In addition, the yarns are unfavorably lowered in breaking strength even when various spinning and drawing conditions are adjusted. Thus, when the yarns are made into a fabric, a problem that the fabric is lowered, in tear strength is unfavorably caused with ease.

<False Twist Textured Yarn>

The two-layer arrangement multifilaments are not particularly limited about the boiling water shrinkage ratio, the thermal stress, the birefringence, thick spots, and other factors thereof. The two-layer arrangement multifilaments may be false twist textured yarn, composite yarn, taslan air jet textured yarn or some other yarn. The two-layer arrangement multifilaments are preferably raw yarn or false twist textured yarn, and are more preferably false twist textured yarn. This is because when the filaments are finished into a high-density product, the filaments are more easily finished into a soft feeling of the fabric by use of false twist textured yarn than by use of raw yarn.

False twist textured yarn is a yarn that has been subjected to crimping, this situation being different from that of raw yarn, such as spin-drawn yarn. Thus, monofilaments thereof are less easily put together into a dense state so that irregularities are easily generated in the surface of a fabric thereof. Thus, there has been conventionally caused a problem that when false twist textured yarn is used for a fabric, the fabric is easily deteriorated in air permeability after washed. Even when false twist textured yarn is used in the present invention, the fabric is largely restrained from being deteriorated in air permeability. Although reasons therefor are not necessarily made clear, the reasons are assumed as follows.

The monofilaments constituting the false twist textured yarn are filaments that have each been crimped. Accordingly, in the false twist textured yarn, the two-layer-arranged monofilaments are put together more densely by the crimping than in any yarn in the state that monofilaments are pulled to be regularly arranged. Thus, the monofilaments are strongly caught by each other. As a result, even when external force is applied to the fabric in washing or some other operation, the motion of each of the monofilaments in the false twist textured yarn is restrained so that the two-layer arrangement does not collapse. Thus, the fabric would be remarkably restrained from being deteriorated in air permeability when washed.

The contraction recovery of the false twist textured yarn is preferably 10% or more, more preferably 15% or more, and is preferably 40% or less, more preferably 35% or less. When the contraction recovery is in this range, the monofilaments are strongly caught by each other so that the tissues are not easily moved. Thus, also after washed, the fabric can keep the two-layer arrangement stably. On the other hand, if the contraction recovery is less than 10%, the yarn is weakly crimped so that the surface of the yarn turns into a substantially flat state. Thus, the monofilaments are not easily caught by each other, so that a stable two-layer arrangement is not easily formed. As a result, the tissues are easily moved so that the air permeability durability against washing may be deteriorated. If the contraction recovery is more than 40%, the monofilaments are too strongly caught by each other so that a two-layer arrangement can be stably formed; however, the filaments are not easily disentangled, and further the feeling of the fabric itself easily gets fluff unfavorably.

<Processing Method for False Twist Textured Yarn>

The false twist textured yarn may be of a type produced by any method, such as a pin type, a friction type, a nip belt type or an air-twisting type, which is generally used. The yarn is preferably of a friction type from the viewpoint of productivity.

<Fineness of Monofilaments>

The fineness of the monofilaments, which constitute the two-layer arrangement multifilaments, is not particularly limited. The fineness is preferably 0.5 dtex or more, more preferably 1.0 dtex or more, and is preferably 2.0 or less, more preferably 1.5 dtex or less. When the fineness of the monofilaments is set into the range, a fabric is yielded which has an appropriate tear strength and a low air permeability while the fabric has a soft feeling. On the other hand, if the fineness is less than 0.5 dtex, the fabric is liable to be weak against friction onto the outside. Moreover, the number of the monofilaments is required to be made considerably large in order to form the two-layer arrangement. Thus, the yarn material is not easily spun, so that the fabric-producing operation may become difficult. If the fineness is more than 2.0 dtex, the fabric cannot easily gain a soft feeling or a low air permeability.

<Cross Sectional Shape of any One of Monofilaments>

The cross sectional shape of any one of the monofilaments, which constitute the two-layer arrangement multifilaments, is not particularly limited, and may be a circle (examples thereof including ellipses), triangle, Y-shape, cross, W-shape, V shape, ∞-shape, gear shape or heart shape, or some other shape. From the viewpoint of the strength thereof; a circular cross section is preferably used. Even when monofilaments each having a circular cross section are used, the cross sectional shape thereof may be deformed after the monofilaments are subjected to calendering.

<Number of Monofilaments in Two-Layer Arrangement Multifilaments>

The number of the monofilaments in any one of the two-layer arrangement multifilaments is preferably 12 or more, more preferably 15 or more, and is preferably 22 or less, more preferably 20 or less. When the number of the monofilaments is set into the range, the two-layer arrangement multifilaments are easily formed. Thus, a fabric is yielded which has thinness and softness while the fabric can keep a low air permeability also after washed. On the other hand, if the number of the monofilaments is made larger than 22 the monofilaments need to be made thin in order to satisfy the above-mentioned total fineness. Thus, the fabric is liable to be weak against friction onto the outside. If the number is made smaller than 12, a one-layer arrangement is easily formed. Thus, even when the fabric initially gains a low air permeability, the air permeability is not easily kept after the fabric is washed.

In the high-density fabric of the present invention, the following may be used in addition to the two-layer arrangement multifilaments: multifilaments in the form of an arrangement of one layer, or three or more layers, or a synthetic fiber such as a short fiber. The fineness of the synthetic fiber is as described above. Other properties thereof are preferably equivalent to those of the two-layer arrangement multifilaments.

<Spinning Method>

In the present invention, the method for spinning the multifilaments (including the two-layer arrangement multifilaments) is not particularly limited. For example, polyamide based multifilaments or polyester based multifilaments can be produced by case of a spin-draw continuous machine in a spin-draw mode, or through two steps using a spinning machine and a drawing machine. In the spin-draw mode, the rotary speed of the spin yarn pulling godet roller is set into the range preferably from 1500 to 4000 m/minute, more preferably from 2000 to 3000 in/minute. When the rotary speed of the spin yarn pulling godet roller is in this range, a good industrial productivity is exhibited so that the spinning is favorable from the viewpoint of costs. On the other hand, if the rotary speed is less than 1500 m/minute, the yarn turns into the non-drawn state yarn so that the yarn is not easily wound up. If the rotary speed is more than 4000 m/minute, the yarn-productivity becomes good; however, yarn-breaking, naps and others are generated so that the spinning operability may be deteriorated.

Hereinafter, the high-density fabric of the present invention will be described in detail.

<Fabric Texture>

In the present invention, the fabric texture of the high-density fabric is not particularly limited, and may be any texture such as plain weave, twill weave, or sateen weave. In order to make the fabric low in air permeability, plain weave is preferably used. In order to make the fabric high in tear strength, rip stop weave, particular, double rip stop weave is preferred.

The weaving machine used for producing the fabric is not particularly limited, and may be a water jet loom weaving machine, an air jet loom weaving machine, or a Rapier weaving machine.

<Calendering>

The woven fabric is subjected to refining, relaxing, presetting, dyeing, finishing or some other processing by use of a processing machine for an ordinary thin fabric. At this time, at least one surface of the fabric is preferably subjected to calendering.

When at least one surface of the fabric is subjected to calendering, monofilaments in the calendered surface are compressed and fixed into a two-layer arrangement. Thus, a fabric is yielded which is low in air permeability while the fabric is thin and compact.

Calendering may be applied to only one surface of the fabric only the surface is rendered a glossy surface), or two surfaces thereof the surfaces are rendered glossy surfaces). When calendering is applied to both the surfaces, fibrils at the fabric front surface are crushed so that an unfavorable gloss is generated, and a hard feeling is generated. Additionally, the cloth deteriorates in away-from-skin property, thus when the cloth gets wet, the cloth may give an unpleasant feel, such as a feel such that the cloth adheres to the skin. Therefore, when such a feeling is not preferred, it is desired to apply calendering to only one surface of the fabric. For reference, the number of times of the calendering to the fabric is not particularly limited, and may be only one, or two or more as far as the fabric can be sufficiently compressed.

The temperature for calendering is not particularly limited, and is preferably at least 80° C. higher than the glass transition temperature of the used material, more preferably at least 120° C. higher than the glass transition temperature. The temperature for calendering is preferably at least 20° C. lower than the melting point of the used material, more preferably at least 30° C. lower than the melting point. When the calendering temperature is set into the range, a fabric is yielded which has both of a low air permeability and a high tear strength. On the other hand, if the calendering temperature is lower than "the glass transition temperature of the used material 80° C." the compression degree of the monofilaments in the multifilaments is weak so that a fabric low in air permeability is not easily yielded. If the temperature is higher than "the melting point of the used material −20° C.", the compression degree of the monofilaments in the multifilaments is heightened; however, the tear strength of the fabric may be remarkably lowered. For example, when the material is a polyamide, the calendering temperature is preferably from 130 to 200° C., more preferably from 120 to 190° C. When the material is a polyester, the calendering temperature is preferably from 160 to 240° C.

The pressure for the calendering is preferably 0.98 MPa (10 kgf/cm$^2$ or more, more preferably 1.96 MPa (20 kgf/cm$^2$) or more, and is preferably 5.88 MPa (60 kgf/cm$^2$) or less, more preferably 4.90 MPa (50 kg/cm$^2$) or less. When the calendering pressure is set into the range, a fabric is yielded which has both of a low air permeability, and tear strength. On the other hand, if the calendering pressure is less than 0.98 MPa (10 kgf/cm$^2$), the compression degree of the monofilaments in the multifilaments is weak so that a fabric low in air permeability may not be yielded. If the calendering pressure is more than 5.88 MPa (60 kgf/cm$^2$), the monofilaments in the multifilaments are excessively compressed so that the tear strength of the fabric may be remarkably lowered.

The raw material of the calender is not particularly limited. One of the two rolls thereof is preferably made of a metal. About the metal roll, the temperature of the roll itself can be adjusted, and further therethrough the cloth surface can be evenly compressed. The other roll is not particularly limited. The roll may be an elastic roll such as a paper roll, a cotton roll or a resin roll besides a metal roll. When a resin roll is used, the material of the surface thereof is preferably a nylon.

<Another Processing>

The high-density fabric of the present invention may be optionally subjected to a functionalizing processing that may be of various types, such as water repellent treatment, coating or laminating, or soft finishing or resin finishing for adjusting the feeling or strength of the fabric. The softening agent that may be used is, for example, an amino-modified silicone, or a polyethylene-based, polyester-based or paraffin based softening agent. In order to finish the fabric, a post-processing, such as softening processing or silicone processing, may be applied thereto. The resin finishing agent that may be used is a resin that may be of various types, such as melamine resin, glyoxal resin, or any urethane-, acrylic- or polyester-resin.

<Cover Factor>

In the present invention, the total cover factor (CF) of the fabric is preferably 1700 or more, more preferably 1800 or more, and is preferably 2200 or less, more preferably 2000 or less. When the total cover factor is set into the range, a fabric is yielded which has an appropriate tear strength and a low air permeability. On the other hand, if the total cover factor is less than 1700, a fabric low in air permeability is not yielded. If the factor is more than 2200, the density of the warp and that of the weft become large. Thus, a light and softy fabric is not gilded.

The total cover factor (CF) is calculated by the following equation.

$$CF=T\times(DT)^{1/2}+W\times(DW)^{1/2},$$

wherein T and W represent the warp density and the weft density (the number of yarns/2.54 cm) of the fabric, and DT and DW represent the fineness (dtex) of the warp constituting the fabric and that (dtex) of the weft constituting it.

The cover factor ($CF_A$) in at least one direction of the warp and weft directions, which has the two-layer arrangement multifilaments present, is preferably 700 or more, more preferably 750 or more, and is preferably 900 or less, more preferably 880 or less. When the cover factor in at least one direction of the warp and weft direction is in this range, the monofilaments easily form into the two-layer arrangement. On the other hand, if the cover factor in either the warp direction or the weft direction is more than 900, the monofilament become high in density to turn into an arrangement of three or more layers. Thus, a thin and soft fabric is not yielded. If the cover factor is less than 700, the monofilaments become small in density. It is therefore necessary for the formation of the two-layer arrangement that the monofilaments are made fine and the number thereof is made large. As a result, the spinning becomes difficult or the cloth may be disturbed by surface friction onto the outside.

The cover factor ($CF_A$) is calculated by the following equation.

$$CF_A=A\times(DA)^{1/2},$$

wherein A represents the warp density and the weft density (the number of yarns/2.54 cm) of the fabric, and DA represents the fineness (dtex) of the warp constituting the fabric and that (dtex) of the weft constituting it.

<Weight Per Unit Area>

The weight of the fabric per unit area is not particularly limited. The weight is preferably 20 g/m$^2$ or more, more preferably 25 g/m$^2$ or more, and is preferably 60 g/m$^2$ or less, more preferably 55 g/m$^2$ or less. When the weight of the fabric per unit area is set into the range, a fabric light, thin, and low in air permeability is yielded. On the other hand, if the weight of the fabric per unit area is less than 20 g/m$^2$, the resultant cloth is thin and light; however, a fabric low in air permeability is not easily yielded. If the weight of the fabric per unit area is more than 60 g/m$^2$, the fabric gives a low air permeability; however, the resultant cloth is liable to be thick.

<Tear Strength>

The tear strength of the fabric according to the pendulum method is not particularly limited. The tear strength in each of the warp direction and the weft direction is preferably 8 N or more, more preferably 10 N or more, even more preferably 12 N or more, and is preferably 50 N or less, more preferably 40 N or less, even more preferably 30 N or less. When the tear strength of the fabric is set into the range, a light and thin fabric having a required tear strength is yielded. On the other hand, if the tear strength is less than 8 N, the fabric may be lacking in tear strength in accordance with the usage thereof. If the tear strength is more than 50 N, the fineness needs to be made large. Following this matter, the cloth is liable to turn thick and hard unfavorably.

<Air Permeability and Washing Durability>

The air permeability of the fabric as the initial value before washed, which is measured with reference to the air permeability A method (Frazier type method) prescribed in JIS L 1096 8. 27. 1, is preferably 1.5 cc/cm$^2$/s or less, more preferably 1.0 cc/cm$^2$/s or less. When the air permeability before washing is 1.5 cc/cm$^2$/s is or less, a fabric excellent in down proof is yielded.

The air permeability of the fabric, which is measured by the above-mentioned method after the fabric is washed three times, is preferably 2.0 cc/cm$^2$ is or less, more preferably 1.5 cc/cm$^2$ is or less. When the air permeability after the three washing operations is 2.0 cc/cm$^2$/s or less, down does not spout from the fabric while the fabric is washed. Thus, the fabric is excellent in washing durability. On the other hand, if the air permeability after the three washing operations is more than 2.0 cc/cm$^2$/s, down easily spout therefrom. Thus, this may cause a large fall in the quality of a down jacket or some other.

EXAMPLES

The following will describe the present invention in detail by way of Examples and Comparative Examples; however, the present invention is not limited thereto. All examples obtained by changing or modifying Examples are included in the technical scope of the present invention as far as the obtained examples do not depart from the subject matters of the present invention that have been described above or will be described below. Measuring methods used in the present invention are as follows.

<Fineness>

The total fineness of multifilaments is determined by preparing three cassettes of 100-m-long multifilaments therefrom, measuring the mass (g) of each of the cassettes, averaging the resultant masses, and then multiplying the average value by 100. The fineness of the monofilaments is a value obtained by dividing the fineness of the multifilaments by the number of the monofilaments.

<Intrinsic Viscosity>

The intrinsic viscosity (IV) is a value obtained by using a mixed solvent composed of p-chlorophenol and tetrachloroethane (ratio of p-chlorophenol to tetrachloroethane=75/25) to measure the intrinsic viscosity [η] thereof at 30° C., and converting the measured value into the intrinsic viscosity (IV) of a mixed solvent composed of phenol and tetrachloroethane (ratio of phenol to tetrachloroethane=60/40).

$$IV=0.8325\times[\eta]+0.005$$

<Relative Viscosity>

A sample is dissolved in an extra pure reagent of concentrated sulfuric acid that has a concentration of 96.3±0.1% by mass to give a polymer concentration of 10 mg/mL. In this way, a sample solution is prepared. An Ostwald viscometer giving a water dropping time of 6 to 7 seconds at a temperature of 20±0.05° C. is used to measure the dropping time T1 (seconds) of 20 mL of the prepared sample solution and the dropping time T0 (seconds) of 20 mL of the concentrated sulfuric acid extra pure reagent, which has the concentration of 96.3±0.1% by mass and is used far the dissolution of the sample, at 20±0.05° C. The relative viscosity (RV) of the used material is calculated from the following equation:

$$RV=T1/T0$$

<Breaking Strength>

A 4301-model of a universal material testing machine manufactured by Instron Japan Co., Ltd. is used to apply, to a sample (sample length: 20 cm, and tensile speed: 20 cm/minute), a load of 1/33 gram per fineness (denier). This measurement is made three times. When a yarn is broken, the strength is measured, and the average thereof is defined as the breaking strength.

<Breaking Elongation>

The same measuring method as used for the breaking strength is carried out, and the average of the elongations when a yarn is broken, respectively, is defined as the breaking elongation.

<Contraction Recovery>

The contraction recovery (CR) of a false twist textured yarn is measured with reference to the contraction recovery prescribed in JIS L 1013 8. 12.

<Method for Measuring State that Monofilaments are Put Together>

A sample of a cloth having a cross section which is to be photographed in the warp direction or the weft direction is set to an SEM sample stand in a usual manner. At this time, in order to cut out cross sections of multifilaments perpendicularly to the multifilaments without disturbing the cross sections, the sample is frozen with liquid nitrogen, and then a sharp safety razor is used. Further, a ruler is used to put edge into the cloth between the multifilaments and in such a manner along the multifilaments, and the multifilament cross sections are cut out. For example, when the warp cross sections are photographed, the edge is put into the cloth between the wefts and along the wefts. Thereafter, the SEM is used to take cross section photographs under a power permitting about 15 to 20 ones out of the multifilaments to be viewed in one visual field (Power: 200 magnifications). The taken photographs are three photographs taken at will from different sites. Each of the photographs is observed to count the number of multifilaments made in a two-layer arrangement. In accordance with a criterion described below, the state that the monofilaments are put together is determined.

A case where the proportion of the number of the two-layer arrangement multifilaments is 50% or more of the total number of the multifilaments is determined to be a "two-layer" arrangement; a case where the proportion of the number of the two-layer arrangement multifilaments is less than 50% and the proportion of the number of three- or more-layer arrangement multifilaments is 50% or more is determined to be a "three- or more-layer" arrangement; and a case where the proportion of the number of the two-layer arrangement multifilaments is less than 50% thereof and the proportion of the number of one-layer arrangement multifilaments is 50% or more is determined to be a "one-layer" arrangement.

<Weight Per Unit Area>

The weight of a fabric per unit area is measured with reference to the mass per unit area prescribed in JIS L 1096 8.4.

<Cover Factor>

The total cover factor (CO is calculated by the following equation.

$$CF=T\times(DT)^{1/2}+W\times(DW)^{1/2}$$

, wherein T and W represent the warp density and the weft density (the number of yarns/2.54 cm) of the fabric, and DT and DW represent the fineness (dtex) of the warp constituting the fabric and that (dtex) of the weft constituting it.

The cover factor ($CF_A$) in at least one direction of the warp and weft directions is calculated by the following equation.

$$CF_A=A\times(DA)^{1/2}$$

, wherein A represents the warp density and the weft density (the number of yarns/2.54 cm) of the fabric, and DA represents the fineness (dtex) of the warp constituting the fabric and that (dtex) of the weft constituting it.

<Tear Strength>

The tear strength of the fabric is measured with reference to the tear strength D method (pendulum method) prescribed in JIS L 1096 8.15.5. The tear strength is measured both in the warp and the weft directions.

<Air Permeability>

The air permeability of the fabric is measured with reference to the air permeability A method (Frazier type method) prescribed in JIS L 1096 8. 27. 1.

<Washing Durability>

A fabric is washed by repeating washing-dehydrating-drying steps three times in accordance with an F-2 method described in Fabric Dimension Change of JIS L 1096 8. 64. 4. The method for the drying is line drying. The air permeability after the three washing steps is measured by the above-mentioned method, and is defined as the washing durability.

<Feeling>

The feeling of a fabric is evaluated at 5-class as follows: five examiners are selected; a dyed and set plain weave of 56T24F of nylon 6 (130 warps per 2.54 cm; and 116 wefts per 2.54 cm) is used as a blank; and the fabric is judged to have score 5 when felt to be softer than the blank; and the fabric is judged to have score 1 when felt to have a feeling near to that of blank. In tables described below, the average of the scores is shown.

<Piling Property>

The pilling property of a fabric is mea red in accordance with a pilling measuring A method prescribed in JIS L 1076 8.1.

Example 1

Nylon 6 polymer chips having a relative viscosity of 3.5 were melted and spun from a spinning mouth having 20 jetting-out openings (nozzle diameter: 0.22ϕ) at a spinning temperature of 288° C. and a jetting-out rate of 9.44 g/minute. Out of its two godet rollers; the first godet roller and the second godet miller were each set to have a rotary speed of 3077 m/minute, and the winding speed was set to 3100 m/minute. In this way, a POY of multifilaments was yielded which were each composed of 20 monofilaments each having a circular cross section, and which each had a total fineness of 33.1 dtex. A TMC machine manufactured by TMT Machinery, Inc., was used to produce a false twist textured yarn having a fineness of 22 dtex from the resultant POY. A disk ratio (D/Y) was 1.55, a heater temperature was 180° C. and the disk structure was a urethane disk 1-7-1 structure. Further, the twist textured yarn was produced at a false twist texturing T1 tensile force (twisting tensile force) of 12 gf, a false twist texturing T2 tensile force (de-twisting tensile force) of 12 gf, a processing speed of 450 in/minute, and a draw speed of 1.08. The resultant false twist textured yarn was evaluated by the above-mentioned methods. The results are shown in Table 1.

The false twist textured yarn was used as warps and wefts to be woven into a double rip texture by means of a water jet loom weaving machine while the warp density and the weft density were set to 213 warps per 2.54 cm and 173 wefts per 2.54 cm, respectively.

An open soaper was used to refine the resultant cloth in a usual manner, and a pin tenter was used to preset the cloth at 190° C. for 30 seconds. A liquid flow dyeing machine (CIRCULAR NS, manufactured by Hisaka Works, Ltd.) was used to dye the cloth into blue with an acidic dye, and then the cloth was subjected to middle-setting at 180° C. for 30 seconds. Thereafter, one surface of the cloth was subjected to calendering (cylindering at a temperature of 180° C., a pressure of 2.45 MPa (25 kgf/cm$^2$), and a speed of 20 re/minute) two times, and then the cloth was subjected to soft finishing. The resultant fabric was evaluated by the above-mentioned methods. The results are shown in Table 1.

Example 2

Spinning and false twist texturing were performed. In the same way as in Example 1 except that nylon 6 polymer chips having a relative viscosity of 2.5 were used and the spinning temperature and the jetting-out rate were changed to 266° C. and 12.01 g/minute, respectively. In this way, a false twist textured yarn composed of 20 monofilaments and having a fineness of 28 dtex was yielded. Next, weaving and processing were performed in the same way as in Example 1 except that this false twist textured yarn was used as warps and wefts, and the warp density and the weft density were set to 200 warps per 2.54 cm and 153 wefts per 2.54 cm, respectively. The resultant false twist textured yarn and fabric were evaluated by the above-mentioned methods. The results are shown in Table 1.

Example 3

Spinning and false twist texturing were performed in the same way as in Example 1 except that the jetting-out rate at the time of the spinning was changed to 472 g/minute. In this way, a false twist textured yarn composed of 20 monofilaments and having a fineness of 11 dtex was yielded. Next, weaving and processing were performed in the same way as in Example 1 except that this false twist textured yarn was used as warps and wefts, and the warp density and the weft density were set to 300 warps per 2.54 cm and 218 wefts per 2.54 cm, respectively. The resultant false twist textured yarn and fabric were evaluated by the above-mentioned methods. The results are shown in Table 1.

Example 4

Nylon 6 polymer chips having a relative viscosity of 3.5 were melted and spun from a spinning mouth having 20 jetting-out openings (nozzle diameter: 0.22ϕ) at a spinning temperature of 288° C. and a jetting-out rate of 7.16 g/minute. Out of its three godet rollers, the first roller, the second roller and the third roller were set to have rotary speeds of 2000 m/minute, 2500 m/minute, and 3400 m/minute, respectively. The temperature of the second roller and that of the third roller were set to 160° C. and 141° C., respectively, and the winding speed was set to 3250 in/minute. In this way, a spun and drawn yarn was yielded which was composed of 20 monofilaments each having a circular cross section, and which had a total fineness of 22 dtex. The resultant spun and drawn yarn was, without being false-twist-textured, woven and processed in the same way as in Example 1. The resultant spun and drawn yarn, and fabric were evaluated by the above-mentioned methods. The results are shown in Table 1.

Example 5

The false twist textured yarn in Example 1 was used as warps and wefts to perform weaving and processing in the same way as in Example 1 except that the warp density and the weft density were changed to 250 warps per 2.54 cm and 178 wefts per 2.54 cm, respectively. The resultant fabric was evaluated by the above-mentioned methods. The results are shown in Table 1.

Example 6

The false twist textured yarn in Example 1 was used as warps and wefts to perform weaving and processing in the same way as in Example 1 except that the warp density and the weft density were changed to 173 warps per 2.54 cm and 213 wefts per 2.54 cm, respectively. The resultant fabric was evaluated by the above-mentioned methods. The results are shown in Table 1.

Comparative Example 1

Spinning and false twist texturing were performed in the same way as in Example 1 except that the number of the jetting-out openings was changed to 24, and the jetting-out rate at the time of the spinning was changed to yield a POY having a fineness of 49.5 dtex. In this way, a false twist textured yarn composed of 24 monofilaments and having a fineness of 33 dtex was yielded. Next, weaving and processing were performed in the same way as in Example 1 except that this false twist textured yarn was used as warps and wefts, and the warp density and the weft density at the time of the weaving were set to 186 warps per 2.54 cm and 124 wefts per 2.54 cm, respectively. The resultant false twist textured yarn and fabric were evaluated by the above-mentioned methods. The results are shown in Table 2.

Comparative Example 2

Spinning and false twist texturing were performed in the same way as in Example 1 except that the number of the jetting-out openings was changed to 48. In this way, a false twist textured yarn composed of 48 monofilaments and having a fineness of 22 dtex was yielded. Next, this false twist textured yarn was used as warps and wefts to be woven and processed in the same way as in Example 1. The resultant false twist textured yarn and fabric were evaluated by the above-mentioned methods. The results are shown in Table 2.

Comparative Example 3

The false twist textured yarn produced in Example 1 was used to perform weaving and processing in the same way as in Example 1 except that the warp density and the weft density were changed to 240 warps per 2.54 cm and 238 wefts per 2.54 cm, respectively. The resultant fabric was evaluated by the above-mentioned methods. The results are shown in Table 2.

Comparative Example 4

Spinning and false twist texturing were performed in the same way as in Example 1 except that then number of the jetting-out openings was changed to 7 and the jetting-out rate at the time of the spinning was changed to yield a POY having a fineness of 16.5 dtex. In this way, a false twist textured yarn composed of 7 monofilaments and having a fineness of 11 dtex was yielded. Next, weaving and processing were performed in the same way as in Example 1 except that this false twist textured yarn was used as warps and wefts, and the warp density and the weft density sere set to 300 warps per 2.54 cm and 218 wefts per 2.54 cm, respectively. The resultant false twist textured yarn and fabric were evaluated by the above-mentioned methods. The results are shown in Table 2.

TABLE 1

| | | Example 1 | Example 2 | Example 3 | Example 4 | Example 5 | Example 6 |
|---|---|---|---|---|---|---|---|
| Multi-filaments | Material | Nylon 6 | Nylon 6 | Nylon 6 | Nylon 6 | Nylon 6 | Nylon 6 |
| | Total fineness (dtex) | 22 | 28 | 11 | 22 | 22 | 22 |
| | The number of monofilaments | 20 | 20 | 20 | 20 | 20 | 20 |
| | Monofilament fineness (dtex) | 1.1 | 1.4 | 0.55 | 1.1 | 1.1 | 1.1 |
| | Type | False twist textured yarn | False twist textured yarn | False twist textured yarn | Raw yarn | False twist textured yarn | False twist textured yarn |
| | Breaking strength (cN/dtex) | 5.1 | 4.5 | 5.0 | 5.6 | 5.1 | 5.1 |
| | Breaking elongation (%) | 30.0 | 30.2 | 29.0 | 31.0 | 30.0 | 30.0 |
| | Contraction recovery (%) | 22 | 22 | 20 | 0 | 22 | 22 |
| Fabric | Fabric texture | Double rip | Double rip | Double rip | Double rip | Double rip | Double rip |
| | Finished warp density (the number of warps per 2.54 cm) | 223 | 210 | 310 | 223 | 260 | 185 |
| | Finished weft density (the number of wefts per 2.54 cm) | 185 | 165 | 230 | 185 | 190 | 223 |
| | Cover factor in warp direction | 1045 | 1111 | 1028 | 1045 | 1219 | 867 |
| | Cover factor in weft direction | 867 | 873 | 762 | 867 | 891 | 1045 |
| | Total cover factor | 1912 | 1984 | 1790 | 1912 | 2110 | 1912 |
| | Calendering | Done | Done | Done | Done | Done | Done |
| | State that monofilaments are put together (the warp/the weft) | Three-layer/ two-layer | Three-layer/ two-layer | Three-layer/ two-layer | Three-layer/ two-layer | Three-layer/ two-layer | Two-layer/ three-layer |
| Fabric evaluation | Tear strength (N) (warp direction × weft direction) | 10.5 × 10.0 | 9.5 × 8.2 | 11.0 × 10.0 | 12.0 × 12.0 | 10.1 × 10.0 | 11.0 × 11.0 |
| | Initial air permeability (cc/cm$^2$/s) | 0.90 | 0.85 | 0.90 | 0.70 | 0.70 | 0.90 |
| | Air permeability after three washing steps (cc/cm$^2$/s) | 0.95 | 1.05 | 1.10 | 1.00 | 0.80 | 0.95 |
| | Thickness (mm) | 0.07 | 0.08 | 0.05 | 0.07 | 0.07 | 0.07 |
| | Weight per unit area (g/m$^2$) | 40.2 | 47.0 | 26.7 | 40.0 | 46.0 | 40.2 |
| | Feeling | 4 | 3 | 5 | 4 | 3 | 4 |
| | Peeling property (class) | 3 | 3 | 3 | 3 | 3 | 3 |

TABLE 2

| | | Comparative Example 1 | Comparative Example 2 | Comparative Example 3 | Comparative Example 4 |
|---|---|---|---|---|---|
| Multi-filaments | Material | Nylon 6 | Nylon 6 | Nylon 6 | Nylon 6 |
| | Total fineness (dtex) | 33 | 22 | 22 | 11 |
| | The number of monofilaments | 24 | 48 | 20 | 7 |
| | Monofilament fineness (dtex) | 1.4 | 0.46 | 1.1 | 1.6 |
| | Type | False twist textured yarn | False twist textured yarn | False twist textured yarn | Fake twist textured yarn |
| | Breaking strength (cN/dtex) | 5.1 | 5.0 | 5.1 | 5.0 |
| | Breaking elongation (%) | 32.0 | 30.0 | 30.0 | 29.0 |
| | Contraction recovery (%) | 23 | 19 | 22 | 20 |
| Fabric | Fabric texture | Double rip | Double rip | Double rip | Double rip |
| | Finished warp density (the number of warps per 2.54 cm) | 200 | 223 | 250 | 310 |
| | Finished weft density (the number of wefts per 2.54 cm) | 135 | 185 | 250 | 230 |
| | Cover factor in warp direction | 1149 | 1045 | 1172 | 1028 |
| | Cover factor in weft direction | 775 | 867 | 1172 | 762 |
| | Total cover factor | 1924 | 1912 | 2344 | 1790 |
| | Calendering | Done | Done | Done | Done |

TABLE 2-continued

| | | Comparative Example 1 | Comparative Example 2 | Comparative Example 3 | Comparative Example 4 |
|---|---|---|---|---|---|
| | State that monofilaments are put together (the warp/the weft) | Three- or more-layer/ three- or more-layer | Three- or more-layer/ three- or more-layer | Three- or more-layer/ three- or more-layer | Two-layer/ one-layer |
| Fabric evaluation | Tear strength (N) (warp direction × weft direction) | 14.0 × 13.0 | 10.0 × 10.0 | 10.0 × 10.0 | 10.0 × 10.0 |
| | Initial air permeability (cc/cm$^2$/s) | 0.90 | 0.70 | 0.60 | 0.90 |
| | Air permeability after three washing steps (cc/cm$^2$/s) | 1.30 | 0.90 | 0.90 | 2.10 |
| | Thickness (mm) | 0.09 | 0.07 | 0.07 | 0.05 |
| | Weight per unit area (g/m$^2$) | 52.5 | 40.5 | 52.0 | 28.0 |
| | Feeling | 2 | 5 | 2 | 4 |
| | Peeling property (class) | 3 | 1 | 3 | 2 |

As is evident from the results in Table 1, the fabrics of Examples 1 to 6 were thin, and had a soft feeling while the fabrics had a high tear strength and were able to keep a low air permeability after washed. It was also understood that in the fabric of Example 1, wherein the false twist textured yarn was used, the degree of the deterioration in the air permeability by the washing was smaller than the fabric of Example 4, wherein the raw yarn was used, although the two were equal to each other in multifilament fineness.

In the meantime, as understood from the results in Table 2, the fabrics of Comparative Examples 1 to 3 each exhibited a low air permeability since the monofilaments in the calendered surface were formed into an arrangement of three or more layers in each of the warp direction and the weft direction. However, the fabric of Comparative Example 1 had a hard feeling since the high-fineness (33 dtex) multifilaments were used. The fabric of Comparative Example 2 exhibited a pilling property of class 1 since the fineness of the monofilaments was too small. Thus, the fabric was weak against friction onto the outside. The fabric of Comparative Example 3 had a hard feeling since the cover factor was set to be high.

Although the fabric of Comparative Example 4 was thin and compact, the monofilaments in its calendered surface were each made into a one-layer arrangement, so that the fabric was unable to keep a low air permeability after washed.

INDUSTRIAL APPLICABILITY

The high-density fabric of the present invention is light and thin and has a very soft feeling while the fabric has a high tear strength, and can further keep a low air permeability also after washed. Thus, the fabric is favorably used for a side cloth of a down wear, a down jacket, a futon, a sleeping bag or some other.

The invention claimed is:

1. A high-density woven fabric comprising a synthetic fiber wherein (a) the synthetic fiber consists of multifilaments, and the multifilaments consist of monofilaments that are arranged in a two layer form in at least one direction of the warp and weft directions of the woven fabric, (b) the fabric has a cover factor ranging from 700 to 900 in at least one direction of the warp and weft directions which has the multifilaments present, (c) the synthetic fiber has a fineness of 28 dtex or less, (d) the number of monofilaments in each of the multifilaments is from 12 to 22, and (e) the fabric has a total cover factor ranging from 1700 to 2200.

2. The high-density woven fabric according to claim 1, wherein the multifilaments have a total fineness of 11 to 28 dtex.

3. The high-density woven fabric according to claim 1, wherein the multifilaments are false twist textured yarn.

4. The high-density woven fabric according to claim 1, wherein the multifilaments have a breaking strength of 4.5 cN/dtex or more.

5. The high-density woven fabric according to claim 1, wherein a proportion of the multifilaments is 50% or more.

6. The high-density woven fabric according to claim 1, at least one surface of which is subjected to calendering.

7. The high-density woven fabric according to claim 1, wherein an air permeability, which is measured with reference to the air permeability A method prescribed in JIS L 1096 8. 27. 1 after the fabric is washed 3 times, is 2 cc/cm$^2$/s or less.

8. The high-density woven fabric according to claim 2, wherein the multifilaments are false twist textured yarn.

9. The high-density woven fabric according to claim 8, wherein the multifilaments have a breaking strength of 4.5 cN/dtex or more.

10. The high-density woven fabric according to claim 9, wherein a proportion of the multifilaments is 50% or more.

11. The high-density woven fabric according to claim 10, at least one surface of which is subjected to calendering.

12. The high-density woven fabric according to claim 11, wherein an air permeability, which is measured with reference to the air permeability A method prescribed in JIS L 1096 8. 27. 1 after the fabric is washed 3 times, is 2 cc/cm$^2$/s or less.

13. The high-density woven fabric according to claim 2, wherein the multifilaments have a breaking strength of 4.5 cN/dtex or more.

14. The high-density woven fabric according to claim 2, wherein a proportion of the multifilaments is 50% or more.

15. The high-density woven fabric according to claim 2, at least one surface of which is subjected to calendering.

16. The high-density woven fabric according to claim 2, wherein an air permeability, which is measured with reference to the air permeability A method prescribed in JIS L 1096 8. 27. 1 after the fabric is washed 3 times, is 2 cc/cm$^2$/s or less.

17. The high-density woven fabric according to claim 3, wherein the multifilaments have a breaking strength of 4.5 cN/dtex or more.

18. The high-density woven fabric according to claim 3, wherein a proportion of the multifilaments is 50% or more.

19. The high-density woven fabric according to claim 3, at least one surface of which is subjected to calendering.

20. The high-density woven fabric according to claim 3, wherein an air permeability, which is measured with reference to the air permeability A method prescribed in JIS L 1096 8. 27. 1 after the fabric is washed 3 times, is 2 $cc/cm^2/s$ or less.

* * * * *